US007003812B1

(12) United States Patent
Lewis et al.

(10) Patent No.: US 7,003,812 B1
(45) Date of Patent: Feb. 28, 2006

(54) CHINSTRAP FOR PROTECTIVE GARMENT HAVING COLLAR AND PROTECTIVE GARMENT HAVING CHINSTRAP AND HAVING COLLAR

(75) Inventors: Patricia Lewis, Tipp City, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/917,098

(22) Filed: Aug. 12, 2004

(51) Int. Cl.
*A41D 13/00* (2006.01)

(52) U.S. Cl. ..... 2/468

(58) Field of Classification Search ..... 2/60, 2/81, 85, 87, 91, 93, 96, 98, 100, 129, 131, 2/135, 141.1, 141.2, 468
See application file for complete search history.

(56) References Cited

U.S. PATENT DOCUMENTS

| | | | | |
|---|---|---|---|---|
| 1,492,577 | A * | 5/1924 | Obermeyer | 2/5 |
| 5,083,319 | A | 1/1992 | Grilliot et al. | |
| 5,153,941 | A | 10/1992 | Grilliot et al. | |
| 5,167,037 | A | 12/1992 | Grilliot et al. | |
| 5,297,295 | A * | 3/1994 | Barbeau et al. | 2/96 |
| 5,638,547 | A * | 6/1997 | Hewitt | 2/81 |
| 5,991,924 | A | 11/1999 | Grilliot et al. | |
| 6,282,725 | B1 * | 9/2001 | Vanidestine, Jr. | 2/421 |
| 6,324,701 | B1 * | 12/2001 | Alexander | 2/421 |

* cited by examiner

*Primary Examiner*—Gary L. Welch
(74) *Attorney, Agent, or Firm*—Wood, Phillips, Katz, Clark & Mortimer

(57) ABSTRACT

A protective garment having a collar has a chinstrap attached to the collar via an elongate member having two opposite ends, each of which is attached to the collar and one of which is attached detachably to the collar via a hook-and-loop fastener. The chinstrap is adjustable along the elongate member to any on a range of adjusted positions of the chinstrap along the elongate member. Preferably, the elongate member is a strap, which or at least a portion of which is elastic, and the chinstrap has a hem, through which the elongate member passes.

7 Claims, 2 Drawing Sheets

CHINSTRAP FOR PROTECTIVE GARMENT HAVING COLLAR AND PROTECTIVE GARMENT HAVING CHINSTRAP AND HAVING COLLAR

TECHNICAL FIELD OF THE INVENTION

This invention pertains to a chinstrap for a protective garment having a collar and to a protective garment having a collar and having a chinstrap. The protective garment may be a firefighter's coat.

BACKGROUND OF THE INVENTION

As exemplified in U.S. Pat. No. 5,083,319, U.S. Pat. No. 5,153,941, U.S. Pat. No. 5,167,037, and U.S. Pat. No. 5,991,924, the disclosures of which are incorporated herein by reference, it has been known for a protective garment, such as a firefighter's coat, to have a collar, which is divided at a front portion of the protective garment, and to have a chinstrap, which functions to protect the chin and throat regions of the firefighter or other wearer.

As exemplified in U.S. Pat. No. 5,153,941, supra, it has been known for opposite ends of the chinstrap to be detachably attached, via a hook-and-pile fastener, to opposite ends of the collar, at the front portion of the protective garment.

Heretofore, it has been difficult to fit the chinstrap properly to the wearer, who may have a receding or protruding chin, who may have a thin or thick neck, and who may or may not be wearing a face mask for a respirator or for a self-contained breathing apparatus.

SUMMARY OF THE INVENTION

This invention provides, for a protective garment having a collar, a chinstrap, which is attachable to the collar via an elongate member having two opposite ends. The chinstrap is adjustable along the elongate member to any on a range of adjusted positions of the chinstrap along the elongate member. Each of the opposite ends of the elongate member is attachable to the collar. Preferably, at least one of the opposite ends of the elongate member is attachable detachably to the collar. Both of the opposite ends of the elongate member may be detachably attached to the collar.

Preferably, the elongate member is a strap. Optionally, the strap or a portion of the strap is elastic. Preferably, the chinstrap has a hem, through which the elongate member passes. Preferably, the detachably attachable end of the elongate member or each detachably attached end, if both ends are attachable detachably, is attachable detachably to the collar via a hook-and-loop fastener.

This invention also provides a protective garment having a collar and having a chinstrap, which is attached to the collar via an elongate member, as described above.

DETAILED DESCRIPTION OF THE ILLUSTRATED EMBODIMENT

Figure 1:
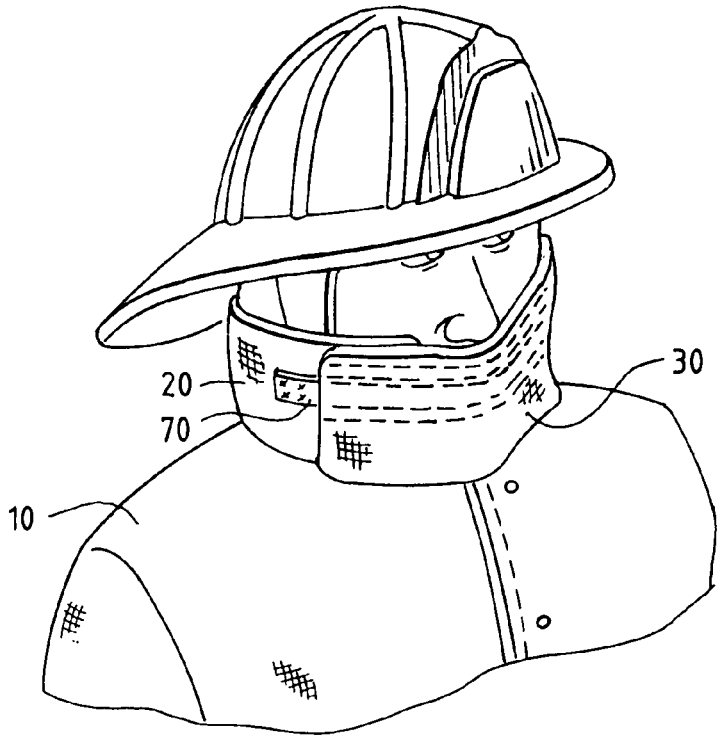
FIG. 1 is a fragmentary, pictorial view of a firefighter wearing a protective coat having a collar and having a chinstrap, which is adjustable along an elongate strap, in one contemplated embodiment of this invention.

As illustrated, a protective garment 10, such as a protective coat for a firefighter, has a collar 20, which is divided into two opposite ends 22, at an upper, front portion of the protective garment 10. As contemplated by this invention, the protective garment 10 has a chinstrap 30, which is attached to the collar 20 via an elongate strap 40 having two opposite ends 42. Each of the opposite ends 42 of the elongate strap 40 is attached to one of the opposite ends 22 of the collar 20. Except as illustrated and described herein, the chinstrap 30 may conform to any of the chinstraps disclosed in U.S. Pat. No. 5,083,319, U.S. Pat. No. 5,153,941, U.S. Pat. No. 5,167,037, and U.S. Pat. No. 5,991,924, supra.

Figure 2:
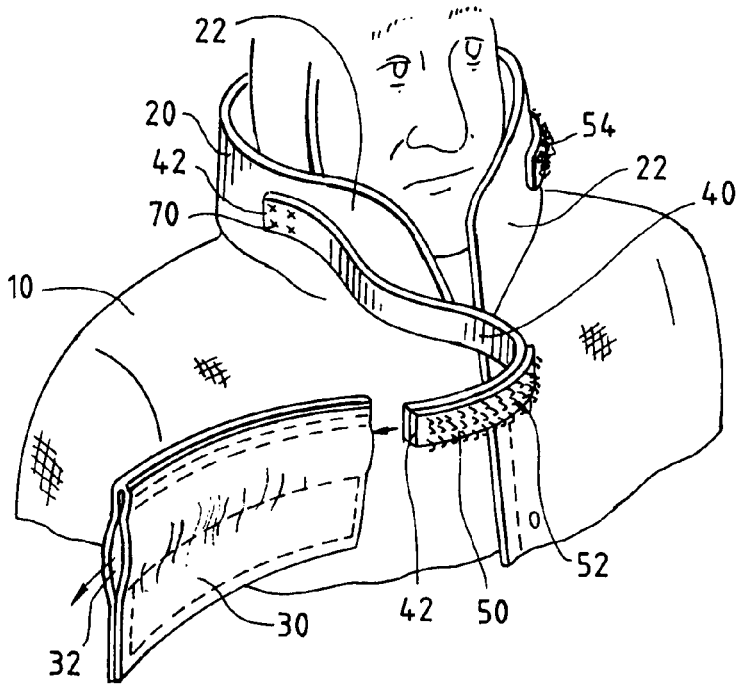
FIG. 2 is a similar, partly exploded view.

In one contemplated embodiment, which is illustrated in FIGS. 1 and 2, one strap end 42 is attached non-detachably to one collar end 22 by stitching 70 (see FIG. 60 or riveting (not illustrated) or otherwise, while the other end 42 of the elongate strap 40 is attached detachably to the other end 22 of the collar 20, via a hook-and-pile (e.g. Velcro™) fastener 50, which comprises a hook-faced patch 52 sewn to the strap end 42 and a pile-faced patch 54 sewn to the collar end 22.

Figure 3:
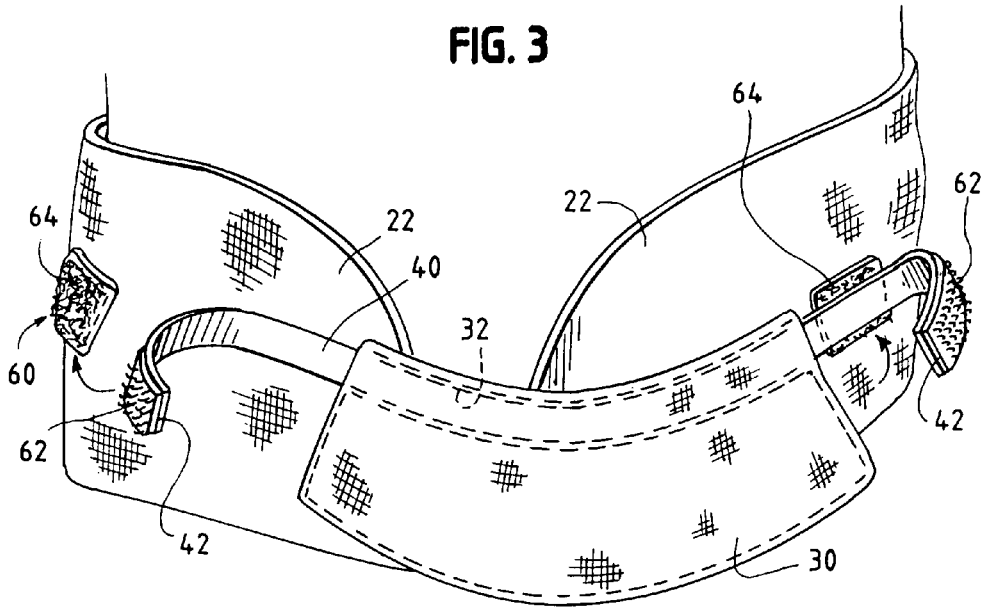
FIGS. 3 and 4 are enlarged, fragmentary details illustrating, in an alternative embodiment, two successive stages in attaching the chinstrap to the collar, via the elongate strap, and in adjusting the chinstrap along the elongate strap.
Figure 4:
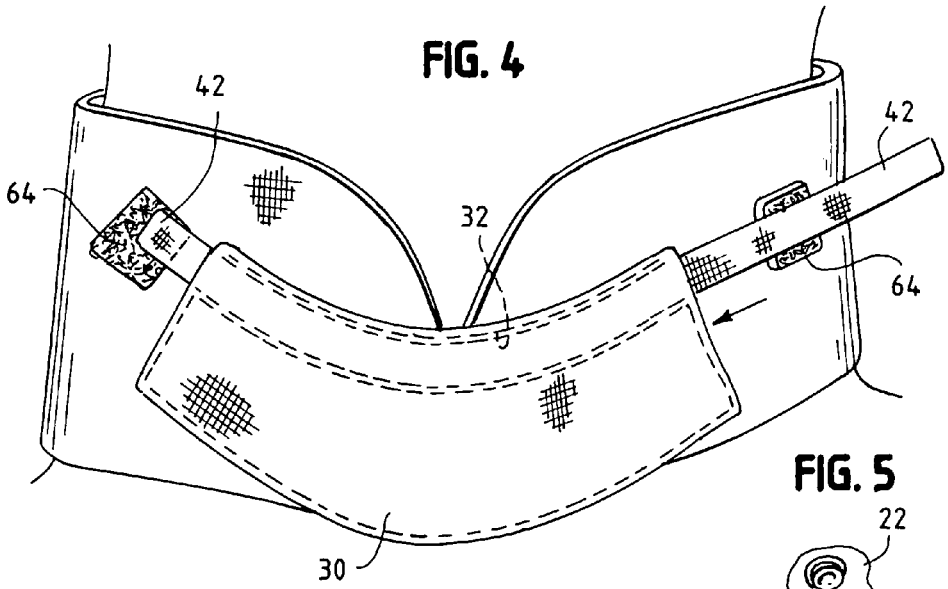
Figure 5:
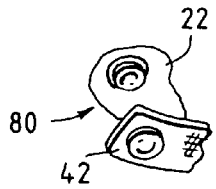
FIG. 5 is a fragmentary detail illustrating, in an alternative embodiment, a snap fastener for attaching one end of the elongate strap detachably to one end of the collar.

In an alternative embodiment, which is illustrated in FIGS. 3 and 4, each strap end 42 is attached detachably attached to one collar end 22, via a hook-and-pile (e.g. Velcro™) fastener 60, which comprises a hook-faced patch 62 sewn to the strap end 42 and a pile-faced patch 64 sewn to the collar end 22. In certain alternative embodiments, a snap fastener 80 (see FIG. 5) or a button (not illustrated) coacting with a button hole (not illustrated) or a lace (not illustrated) tied around a stud (not illustrated) is substituted for the hook-and-pile fastener 60 where one strap end 42 is attached detachably to one collar end 22.

As illustrated, the chinstrap 30, which has plural layers, is sewn to define a hem 32, through which the elongate strap 40 passes so that the opposite ends 42 of the strap 40 are spaced from the chinstrap 30. Thus, the chinstrap 30 is adjustable along the elongate strap 40, between the opposite ends 42 of the elongate strap 40, to any of a range of adjusted positions. The detachably attached end 42 of the elongate strap 40 is attached to one of the collar ends 22, in the preferred embodiment discussed above, or each of the detachably attached ends 42 of the elongate strap 40 is attached to one of the collar ends 22, in the alternative embodiment discussed, so as to vary the exposed lengths of the elongate strap 40 between the chinstrap 30 and the collar ends 22. Optionally, the elongate strap 40 or at least a portion of the elongate strap 40 is elastic, so as to be able to expand elastically or so as to be able to contract elastically.

This invention enables the chinstrap 30 to be easily adjusted to fit a specific wearer, who may have a receding or protruding chin, who may have a thin or thick neck, and who may or may not be wearing a face mask for a respirator or for a self-contained breathing apparatus. If the elongate strap 40 or at least a portion of the elongate strap 40 is elastic, the chinstrap 30 can move inwardly and outwardly without being readjusted. The chinstrap 30 can be easily removed for repair, cleaning, or replacement.

What is claimed is:

1. A protective coat having a collar and having a chinstrap attached to the collar via an elongate member having two opposite ends, each of which extends beyond the chinstrap and is attachable to the collar, wherein the chinstrap is adjustable along the elongate member, between the opposite ends extending beyond the chinstrap, to any on a range of adjusted positions of the chinstrap along the elongate member and wherein the chinstrap has a hem, through which the elongate member passes.

2. The protective coat of claim 1, wherein the attaching means comprises means for attaching at least one of the opposite ends of the elongate member is attachable detachably to the collar.

3. The protective coat of claim 2, wherein the attaching means comprises means for attaching both of the opposite ends of the elongate member is attachable detachably to the collar.

4. The protective coat of claim 2, wherein the attaching means, at each of the opposite ends of the elongate member, attachable detachably to the collar is a hook-and-pile fastener.

5. The protective coat of claim 1, wherein the elongate member is a strap.

6. The protective coat of claim 1, wherein the elongate member is a strap, which is elastic.

7. The protective coat of claim 1, wherein the elongate member is a strap, at least a portion of which is elastic.

* * * * *